United States Patent [19]

Kondo et al.

[11] Patent Number: 4,818,657

[45] Date of Patent: Apr. 4, 1989

[54] LIQUID DEVELOPER FOR ELECTROSTATIC LATENT IMAGE

[75] Inventors: Tsuneyuki Kondo, Kyoto; Yasuhiro Sato, Otsu, both of Japan

[73] Assignee: Toray Industries, Incorporated, Tokyo, Japan

[21] Appl. No.: 99,668

[22] Filed: Sep. 21, 1987

Related U.S. Application Data

[63] Continuation of Ser. No. 874,125, Jun. 13, 1986, abandoned.

[30] Foreign Application Priority Data

Jun. 13, 1985 [JP] Japan ..... 60-127156

[51] Int. Cl.[4] ..... G03G 9/12

[52] U.S. Cl. ..... 430/114; 430/904

[58] Field of Search ..... 430/114, 904

[56] References Cited

U.S. PATENT DOCUMENTS

| | | | |
|---|---|---|---|
| 3,554,946 | 1/1971 | Okuno et al. | 430/115 |
| 3,900,412 | 8/1975 | Kosel | 430/114 |

FOREIGN PATENT DOCUMENTS

| | | |
|---|---|---|
| 0206606 | 4/1981 | . |
| 2103045 | 2/1969 | Fed. Rep. of Germany . |
| 58-122557 | 7/1983 | Japan . |
| 1352067 | 7/1968 | United Kingdom . |

OTHER PUBLICATIONS

Japanese Document J 70935493.

*Primary Examiner*—J. David Welsh

*Attorney, Agent, or Firm*—Birch, Stewart, Kolasch & Birch

[57] ABSTRACT

The present invention relates to a liquid developer for electrostatic latent image, comprising the following components (a), (b) and (c) which are dispersed in an electrical resistive aliphatic hydrocarbon solvent:

(a) a non-gel copolymer which as a whole is insoluble in the solvent and which consists essentially of a copolymer segment soluble in the solvent and a polymer segment insoluble in the solvent, the solvent-soluble copolymer segment containing as main monomer components an alkyl acrylate or an alkyl methacrylate and a cycloalkyl acrylate or a cyckloalkyl methacrylate and/or an aralkyl acrylate or an aralkyl methacrylate, and the solvent-insoluble polymer segment containing vinyl acetate as a main monomer component;

(b) a coloring agent; and (c) a dispersant.

The liquid developer for electrostatic latent image of the present invention does not change in print density and is used effectively in electrophotography, for example, in wet copier and printer, and in electrostatography, for example, in facsimile and electrostatic plotter. Particularly, it is suitable for multicolor printing.

14 Claims, No Drawings

LIQUID DEVELOPER FOR ELECTROSTATIC LATENT IMAGE

This application is a continuation of application Ser. No. 874,125 filed on June 13, 1986, now abandoned.

FIELD OF THE INVENTION

The present invention relates to a liquid developer used for developing an electrostatic latent image formed by electrophotography or electrostatography.

DESCRIPTION OF THE PRIOR ART

Conventional liquid developers comprise an electrical resistive carrier liquid having a high electrical resistance and a low dielectric constant, such as an aliphatic hydrocarbon solvent, and toner particles dispersed in the carrier liquid. The toner particles contain a binder, a coloring agent and other additives. Usually, a natural or synthetic resin as the binder, a pigment or dye as the coloring agent, and a metallic soap or another dispersant as the additive, are mixed and kneaded intimately with the carrier liquid to prepare a concentrate toner having a nonvolatile matter content of about 1-20%, which concentrate toner is then diluted to about 0.1-5% in terms of a non-volatile matter content to obtain a liquid developer.

It is necessary that the toner particles in the liquid toner be stably dispersed while maintaining the binder and the coloring agent in a mutually bonded state and at a certain particle size. In the case where a resin which is soluble in the carrier liquid is used as the binder, the resin component of the binder gradually dissolves out from the toner particles into the carrier liquid, thus resulting in gradual deterioration to the point of fusing and charging the toner particles. On the other hand, where a resin which is insoluble in the carrier liquid is used as the binder, the resulting toner particles would not be uniform and would be coarse, resulting in that the dispersion stability is poor and aggregation and sedimentation of the toner particles would occur during storage.

In an effort to solve the above problems it has been proposed to use as the binder a non-gel graft polymer insoluble, as to the whole of its molecules, in the carrier liquid and having a molecular structure in which a first high polymer segment comprising a vinyl polymer soluble in the carrier liquid and a second high polymer segment comprising a vinyl polymer insoluble in the carrier liquid are bonded to each other through a urethane bond (see Japanese Patent Laid Open No. 122557/1983).

A liquid developer for electrostatic latent image using such a polymer may afford a good print characteristic at the beginning of development, but has not been advantageous in that as the number of prints increases, the concentration of the printed image area is reduced markedly to the extent that it is no longer recovered even by adding a concentrate toner to the developer. Thus such a good print as those developed at the beginning are no longer obtainable. For example, when electrostatic paper of A-1 size was printed continuously at a percent image area of 5%, the concentration of the printed image area decreased rapidly at 100 m printing. It became extremely low at 500 m printing, from which it did not recover even by the addition of a concentrate toner.

The "percent image area of 5%" means that the area of the printed portion is 5% relative to the area of the paper used. The "100 m printing" and "500 m printing" indicate time points at which, in the printing of an oblong A-1 size paper at a predetermined percent image area, the total paper length became 100 m and 500 m, respectively.

SUMMARY OF THE INVENTION

It is an object of the present invention to provide a liquid developer for electrostatic latent image, having a long service life and extremely superior in that even when the toner concentration in the developer decreases, the concentration of the printed image area can be kept constant by newly supplying a concentrate toner. In other words, it is an object of the present invention to provide a liquid developer for electrostatic latent image with little change in concentration of the printed image area.

It is another object of the present invention to provide a liquid developer capable of forming a blur- and stickiness-free image.

It is a further object of the present invention to provide a liquid developer for electrostatic latent image, superior in both trapping characteristic and transparency and capable of affording a clear and highly reproducible image even in multicolor printing.

DESCRIPTION OF THE PREFERRED EMBODMENTS

The present invention relates to a liquid developer for electrostatic latent image, comprising the following components (a), (b) and (c) which are dispersed in an electrical resistive aliphatic hydrocarbon solvent;

(a) a non-gel copolymer which as a whole is insoluble in the solvent and which consists essentially of a copolymer segment soluble in the solvent and a polymer segment insoluble in the solvent, the solventsoluble copolymer segment containing as main monomer components (i) at least one monomer selected from the group consisting of alkyl acrylates and alkyl methacrylates and (ii) at least one monomer selected from the group consisting of cycloalkyl acrylates, cycloalkyl methacrylates, aralkyl acrylates and aralkyl methacrylates, and the solvent-insoluble polymer segment containing vinyl acetate as a main monomer component;

(b) a coloring agent; and (c) a dispersant.

In the present invention, an electrical resistive aliphatic hydrocarbon solvent is used as a dispersion medium, or a carrier liquid, for the non-gel copolymer, coloring agent and dispersant. As such electrical resistive aliphatic hydrocarbon there may be used an aliphatic hydrocarbon having an electrical resistivity not smaller than $10^9$ Ωcm, a dielectric constant not larger than 3 and a boiling point in the range of 68° to 250° C. Examples are hexane, octane, nonane, decane, undecane and dodecane, as well as such organic solvents as "ISOPAR" H, G, L and M which are available commercially (products of EXXON Chemical Inc.). Particularly, solvents boiling in the range of 100° to 200° C., e.g. "ISOPAR" G and H, are preferred.

The liquid developer of the present invention is characterized by containing a non-gel copolymer which consists essentially of a specific copolymer segment ("soluble copolymer segment") soluble in the electrical resistive aliphatic hydrocarbon solvent and a specific polymer segment ("insoluble polymer segment") insoluble in the said solvent and which as the whole of its molecules is insoluble in the said solvent.

The soluble copolymer segment is for stabilizing the dispersion of the copolymer used in the invention and it comprises as main monomer components (i) one or more monomers (hereinafter referred to sometimes as "alkyl (meth)acrylate") selected from alkyl acrylates and alkyl methacrylates and (ii) one or more monomers selected from cycloalkyl acrylates, cycloalkyl methacrylates, (both hereinafter referred to sometimes as "cycloalkyl (meth)acrylate"), aralkyl acrylates and aralkyl methacrylates (both hereinafter referred to sometimes as "aralkyl (meth)acrylate"). Particularly, a copolymer segment containing alkyl (meth)acrylate and cycloalkyl (meth)acrylate as main components is preferred.

The alkyl group of the alkyl (meth)acrylate used as a component of the soluble copolymer segment usually has 3 to 20, preferably 4 to 18, carbon atoms. Examples of the alkyl (meth)acrylates are butyl, isobutyl, tertiary butyl, 2-ethylhexyl, octyl, isononyl, decyl, lauryl, dodecyl and stearyl acrylate or methacrylate.

The cycloalkyl group of the clycloalkyl (meth)acrylate is usually in the form of a six-membered ring of 6 to 8 carbon atoms, preferably cyclohexyl. As most preferred examples are mentioned cyclohexyl acrylate and cyclohexyl methacrylate.

As examples of aralkyl (meth)acrylate, benzyl acrylate and benzyl methacrylate are most preferred.

In general, a polymerization product of alkyl (meth-)acrylate has low glass transition point, so a too high content thereof results in stickiness of the print obtained. If stearyl (meth)acrylate is used in order to avoid such inconvenience, the resultng image will have "blur". According to the present invention, by using the cycloalkyl (meth)acrylate and/or aralkyl (meth)acrylate as a comonomer, there can be formed a stickiness- and blur-free image even in an increased amount of the soluble copolymer segment.

The soluble copolymer segment is a copolymer of (i) at least one alkyl (meth)acrylate and (ii) at least one cycloalkyl (meth)acrylate or aralkyl (meth)acrylate. In addition, another vinyl compound (iii) may also be a comonomer, e.g. versatic vinyl "VeoVa 10" (a product of Shell Kagaku Kabushiki Kaisha). Usually, these components are used in the proportions of (i) 40–80 wt. %, preferably 45–75 wt. %, (ii) 20–60 wt. %, preferably 25–50 wt. %, and (iii) 0–20 wt. %, preferably 5–15 wt. %.

During polymerization of the soluble copolymer segment components it is desirable to use an organic mercaptan as a polymerization modifier because the dispersion stability of the insoluble polymer segment will be improved. As the organic mercaptan there is used a higher alkylmercaptan having an alkyl group of 7 or more carbon atoms, preferably 8–20 carbon atoms, generally employed as a polymerization modifier. Preferred examples are n-octylmercaptan, n-dodecylmercaptan, t-dodecylmercaptan and n-octadecylmercaptan.

As a polymerization catalyst for the soluble copolymer segment, it is not specially limited, but usually there is employed an azobisalkylnitrile having an alkyl group of 3 to 6 carbon atoms. Particularly, azobisisobutyronitrile is preferred.

The insoluble polymer segment is a polymer segment containing vinyl acetate as a main component. It may be a homopolymer of vinyl acetate, or it may be a copolymer of vinyl acetate and one or more of other vinyl monomers such as alkyl acrylates, alkyl methacrylates, cycloalkyl acrylates, cycloalkyl methacrylates, aralkyl acrylates and aralkyl methacrylates.

The vinyl acetate content of the polymer segment containing vinyl acetate as a main component is 50 to 100 wt. %, preferably 65 to 100 wt. %.

The alkyl group of the alkyl acrylate or alkyl methacrylate just referred to above has usually 1 to 20 carbon atoms, preferably 1 to 18, carbon atoms. Preferred examples of alkyl acrylate or alkyl methacrylate are methyl, ethyl, 2-hydroxyethyl, isobutyl, octyl, stearyl and isononyl acrylate or methacrylate. The cycloalkyl group of the cycloalkyl (meth)acrylate is usually in the form of a six-membered ring of 6 to 8 carbon atoms, preferably cyclohexyl. Most preferred examples of the cycloalkyl (meth)acrylate are cyclohexyl acrylate and cyclohexyl methacrylat. Examples of most preferred aralkyl (meth)acrylate, are benzyl acrylate and benzyl methacrylate.

As to the polymerization catalyst used in preparation the insoluble polymer segment, diacyl peroxides are usually employable. Preferred examples are benzoyl peroxide, lauroyl peroxide and p-chlorobenzoyl peroxide.

The copolymer used in the invention may be prepared using, for example, the foregoing aliphatic hydrocarbon solvent as a reaction solvent. For example, there may be adopted a two-step process in which first the monomers for constituting the soluble copolymer segment are added into the reaction solvent and polymerization is allowed to take place and then in this state the monomer or monomers for constituting the insoluble polymer segment are added and polymerized.

The molecular weight of the copolymer used in the invention differs depending on the kind and combination of monomers used, but preferably it is adjusted to a value in the range of 5,000 to 50,000, more preferably 8,000 to 20,000.

In point of uniformity and dispersion stability of toner particles it is necessary that the entirety of the molecules of the copolymer used in the invention, be insoluble in the solvent and not gel-like. Since the liquid developer of the present invention is constituted by such a specific copolymer, even when the toner concentration in the developer decreases, the concentration of the printed image area can be maintained constant by replenishing with a concentrate toner and the life of the liquid developer can be made extremely long.

The ratio of the soluble copolymer segment to the insoluble polymer segment differs depending on the combination of monomers used, but preferably the proportion of the soluble copolymer segment is in the range of 25 to 60 wt. %, more preferably 30 to 45 wt. %, of the whole of the copolymer used in the invention. Within this range, the particle size of the insoluble polymer segment is presumed to become smaller, thus permitting a sufficient bond between the coloring agent and the soluble polymer segment as well as enhanced dispersion stability of the developer. Also in point of uniformity of toner particles as well as transfer and cleaning, the above range is preferred.

As to the copolymer used in the present invention, as long as it contains the soluble copolymer segment and the insoluble polymer segment, the method of bonding those segments is not specially limited. A form of a graft copolymer comprising the soluble copolymer segment with the insoluble polymer segment is preferred.

The coloring agent used in the present invention is not specially limited. Various known coloring agents for this type of toner are employable. Examples are carbon black, organic and inorganic pigments, and dyes.

As examples of coloring agents for black there are mentioned carbon black, Spirit Black, Aniline Black (C.I. Pigment Black 1), and metal calcined pigments. Examples of carbon black are furance black, acetylene black and channel black.

As examples of coloring agents for cyan there are mentioned Dianisidine Blue (C.I. Pigment Blue 25), Phthalocyanine Blue (C.I. Pigment Blue 15), Victoria Pure Blue Lake (C.I. Pigment Blue 1), and Alkali Blue Toner (C.I. Pigment Blue 18).

As examples of coloring agents for magenta there are mentioned azo-lake pigments such as Barium Red 28 (C.I. Pigment Red 48:1), Calcium red 2B (C.I. Pigment Red 48:2), Strontium Red (C.I. Pigment Red 48:3), Manganese Red 2B (C.I. Pigment Red 48:4), Barium Lithol Rd (C.I. Pigment Red 49:1), Calcium Red 52 (C.I. Pigment Red 52:1), Lake Red C (C.I. Pigment Red 53:1), Brilliant Carmine 6B (C.I. Pigment Red 57:1), BON Maroon L-58 (C.I. Pigment Red 58:4), Brilliant Carmine 3B (C.I. Pigment Red 60:1), and Brilliant Scarlet G (C.I. Pigment Red 64:1); lake pigments from basic dyes, e.g. Rhodamine 6G Lake (C.I. Pigment Red 81); and quinacridone pigments e.g. Quinacridone Magenta (C.I. Pigment Red 122).

As examples of coloring agents for yellow there are mentioned insoluble monoazo pigments such as Fast Yellow G (C.I. Pigment Yellow 1) and Fast Yellow 10G (C.I. Pigment Yellow 3), as well as insoluble disazo pigments such as Disazo Yellow AAA (C.I. Pigment Yellow 12), Disazo Yellow AAMX (C.I. Pigment Yellow 13), Disazo Yellow AAOT (C.I. Pigment Yellow 14), and Disazo Yellow AAOA (C.I. Pigment Yellow 17).

The dispersant used in the present invention greatly contributes to the improvement of toner dispersion stability, preservability and printing performance in cooperation with the specific copolymer used as a binder in the invention.

The dispersant is not specially limited, it need only be capable of improving the dispersion stability and preservability of the toner. Preferred examples of the dispersant are metallic salts of naphthenic, octylic and stearic acids. Constituent metals of the metallic salts, Group II and IV metals of the Periodic Table as well as transition metals, such as Li, Ca, Ba, Zr, Mn, Co, Ni, Cu, Zn, Cd, Al and Pt, are effective. Aluminum stearate is particularly preferred. Oligomers, preferably a trimer of aluminum oxide stearate. Examples are "OLIEPE AOS" (a product of Hope Seiyaku, K.K.) and "OLIEPE AOO" (a product of the same company).

The liquid developer of the present invention can be prepared by milling a dispersion of a copolymer prepared in the above manner, the coloring agent such as pigment or dye and the dispersant, intimately by means of a ball mill or a sand mill to obtain a concentrate toner having a non-volatile matter content of about 1–20 wt. % and then diluting the concentrate toner with the foregoing aliphatic hydrocarbon solvent so that the non-volatile matter content becomes about 1–5 wt. %.

The toner particle size is not specially limited, but preferably it is in the range of 0.3 to 1.5 μm in terms of an average particle diameter.

The liquid developer of the present invention is effective in developing an electrostatic latent image obtained by electrophotography or electrostatography. As examples of electrophotography to which the liquid developer of the present invention is applied, there are mentioned a wet type copier and printer, while examples of electrostatography to which the same liquid developer is applied, there are mentioned facsimile and electrostatic plotter.

The liquid developer for electrostatic latent image of the present invention is particularly suitable for multicolor printing because it has an extremely superior trapping property. In multicolor printing, printing is usually performed using developers for three primary colors, i.e. cyan, magenta and yellow, as well as black, successively in an appropriate order. In this case, after formation and development of latent images of a first color, latent images of a second color is formed and developed, and these operations are repeated successively. With conventional developers, however, the multicolor overlapping effect is difficult to attain because of an inferior trapping property, because of difficulty of developing the second and the following colors.

The liquid developer of the present invention has a good trapping property which is attained by using the specific copolymer as a binder. Besides, the transparency is also good. Consequently, a number of colors can be superimposed upon one another and underlying colors can be reflected, thus affording a clear and reproducible multicolor printing effect. Multicolor printing can be effected, for example, by the use of a color electrostatic plotter. The developer of the present invention is preferably applied to a color electrostatic plotter in which electrostatic latent images corresponding to each colors are applied to an electrostatic paper and printing is made by a single apparatus in black, cyan, magenta and yellow colors successively.

As set forth hereinabove, the liquid developer for electrostatic latent image of the present invention contains a specific copolymer as a binder, so even if the toner concentration in the developer decreases, the concentration of the printed image area can be maintained constant by replenishing with a concentrate toner. Thus, an extremely outstanding effect can be attained.

Moreover, since the liquid developer of the present invention is superior in trapping property and transparency, it is possible to obtain a clear image of good reproducibility in multicolor printing.

The following are examples for the production of copolymer (component (a)), i.e, binder, in the present invention as well as working examples of the invention, in which "part" and "parts" are by weight.

PRODUCTION EXAMPLE 1

Into 490 parts of an aliphatic solvent "ISOPAR G" (a product of EXXON Chemical Inc.) which was under stirring and heating to 90° C., a mixed solution of 140 parts 2-ethylhexyl methacrylate, 60 parts benzyl methacrylate, 4 parts dodecylmercaptan and 2 parts azobisisobutyronitrile was dripped for about one hour, and thereafter a polymerization reaction was allowed to take place for another one hour under stirring and heating at 90° C. Then, a mixed solution of 250 parts vinyl acetate, 35 parts 2-ethylhexyl methacrylate, 15 parts benzyl methacrylate and 1 part benzoyl peroxide was added dropwise over a 3 hour period while allowing the polymerization reaction to proceed at 90° C. After the dropwise addition, 0.1 part of azobisisobutyronitrile was added three times at every hour to effect a polymerization.

There was obtained a white emulsion extremely superior in dispersion stability and having a non-volatile matter content of 50 wt. %.

In the copolymer thus obtained, 140 parts 2-ethylhexyl methacrylate and 60 parts benyzl methacrylate constitute a soluble copolymer segment, while 250 parts vinyl acetate, 35 parts 2-ethylhexyl methacrylate, and benzyl methacrylate, constitute an insoluble copolymer segment.

PRODUCTION EXAMPLE 2

The same method as in Production Example 1 was adopted except that 30 parts n-butyl methacrylate, 120 parts 2-ethylhexyl methacrylate and 50 parts cyclohexyl methacrylate were used as monomers to constitute a soluble copolymer segment, while 300 parts vinyl acetate and 100 parts isononyl acrylate were used as monomers to constitute an insoluble copolymer segment. There was obtained a white emulsion extremely superior in dispersion stability and having a non-volatile matter content of 55 wt. %.

PRODUCTION EXAMPLE 3

The same method as in Production Example 1 was adopted except that 120 parts n-octyl methacrylate and 80 parts cyclohexyl methacrylate were used as monomers to constitute a soluble copolymer segment, while 300 parts vinyl acetate was used as a monomer to constitute an insoluble polymer segment. There was obtained a white emulsion extremely superior in dispersion stability and having a non-volatile matter content of 62 wt. %.

PRODUCTION EXAMPLE 4

The same method as in Production Example 1 was adopted except that 130 parts n-octyl methacrylate and 70 parts cyclohexyl methacrylate were used as monomers to constitute a soluble copolymer segment, while 270 parts vinyl acetate and 30 parts n-octyl acrylate were used as monomers to constitute an insoluble copolymer segment. There was obtained a white emulsion extremely superior in dispersion stability and having a non-volatile matter content of 58 wt. %.

PRODUCTION EXAMPLE 5

The same method as in Production Example 1 was adopted except that 95 parts isononyl methacrylate, 10 parts stearyl methacrylate and 95 parts cyclohexyl methacrylate were used as monomers to constitute a soluble copolymer segment, while 200 parts vinyl acetate was used as a monomer to constitute an insoluble polymer segment. There was obtained a white emulsion extremely superior in dispersion stability and having a non-volatile matter content of 62 wt. %.

PRODUCTION EXAMPLE 6

The same method as in Production Example 1 was adopted except that 30 parts versatic vinyl ("VeoVa-10", a product of Shell Kagaku Kabushiki Kaisha), 80 parts 2-ethylhexyl methacrylate, 10 parts stearyl methacrylate and 80 parts cyclohexyl methacrylate were used as monomers to constitute a soluble copolymer segment, while 250 parts vinyl acetate, 92 parts ethyl acrylate and 8 parts 2-hydroxyethyl acrylate were used as monomers to constitute an insoluble copolymer segment. There was obtained a white emulsion extremely superior in dispersion stability and having a non-volatile matter content of 55 wt. %.

PRODUCTION EXAMPLE 7

The same method as in Production Example 1 was adopted except that 120 parts 2-ethylhexyl methacrylate and 80 parts cyclohexyl methacrylate were used as monomers to constitute a soluble copolymer segment, while 300 parts vinyl acetate was used as a monomer to constitute an insoluble polymer segment. There was obtained a white emulsion extremely superior in dispersion stability and having a non-volatile matter content of 52 wt. %.

EXAMPLE 1

The following components were milled for 1 hour by means of a vibration ball mill:

| | |
|---|---|
| Polymer solution obtained in production Example 1 | 100 parts |
| Dianisidine Blue, 700-10S (a product of Toyo Ink Mfg. Co., Ltd.) | 50 parts |
| Aluminum stearate | 5 parts |
| "ISOPAR G" (EXXON Chemical Inc.) | 150 parts |

Thereafter, 405 parts of "ISOPAR G" was further added and milling was made for another 2 hours to obtain a concentrate toner. 10 parts of the concentrate toner was diluted in 90 parts of "ISOPAR G" to obtain a developer.

Using the developer, there was made development by means of an electrostatic plotter "dAstem 8600" (a product of Toyo Denki Seizo K.K.). As a result, there was obtained a clear image. The image had the concentration of the printed image area of cyan of 1.36 (as measured using reflection densitometer of Macbeth RD-918). Even after a continuous 1000 m printing for electrostatic paper of A-1 size at a percent image area of 5%, the concentration of the printed image area of cyan was 0.94. In order to attain the initial developer concentration, the above concentrate toner was added followed by printing; as a result, the print density recovered to 1.33.

EXAMPLES 2-10

Developers were prepared in the same way as in Example 1 except that components were changed as shown in Table 1 below.

TABLE 1

| Example | Binder | Coloring Agent | Dispersant |
|---|---|---|---|
| 2 | Polymer solution obtained in Production Example 2 | Same as in Example 1 | Same as in Example 1 |
| 3 | Polymer Solution obtained in Production Example 3 | Same as in Example 1 | Same as in Example 1 |
| 4 | Polymer solution obtained in Production Example 4 | Same as in Example 1 | Same as in Example 1 |
| 5 | Polymer solution obtained in Production | Same as in Example 1 | Same as in Example 1 |

TABLE 1-continued

| Example | Binder | Coloring Agent | Dispersant |
|---|---|---|---|
| | Example 5 | | |
| 6 | Polymer solution obtained in Production Example 6 | Same as in Example 1 | Same as in Example 1 |
| 7 | Polymer solution obtained in Production Example 1 | Lionogen Mazenta R-F (Toyo Ink Mfg. Co.) | Same as in Example 1 |
| 8 | Polymer solution obtained in Production Example 1 | Finess Yellow G-20-S8 (Toyo Ink Mfg. Co.) | "OLIEPE AOS" (Hope Seiyaku K.K. |
| 9 | Polymer solution obtained in Production Example 1 | Carbon Black MA-100 (Mitsubishi Chemical Ind.) | Same as in Example 1 |
| 10 | Polymer solution obtained in Production Example 1 | Spirit Black PAB (Orient Chemical Inc., Ltd.) | Same as in Example 1 |

Using the developers thus obtained, development was made in the same manner as in Example 1; as a result, clear images were obtained. At this time, such concentrations of the printed image area as shown in table 2 below were observed.

TABLE 2

| Example No. | Concentration of the printed image area | |
|---|---|---|
| 2 | (cyan) | 1.15 |
| 3 | (cyan) | 1.26 |
| 4 | (cyan) | 1.28 |
| 5 | (cyan) | 1.23 |
| 6 | (cyan) | 1.22 |
| 7 | (magenta) | 1.29 |
| 8 | (yellow) | 1.26 |
| 9 | (black) | 1.32 |
| 10 | (black) | 1.20 |

Using each of the developers, a continuous 1000 m printing was performed for electrostatic paper of A-1 size at a percent image area of 5%. Even after the printing, there was no the concentration of printed image area lower than 0.8. In order to obtain the initial developer concentrations, the respective concentrate toners were added to the developers; as a result, the concentrations of the printed image area nearly recovered to the values shown in Table 2.

EXAMPLE 11

The electrostatic paper which had been developed using the developer obtained in Example 1 was rewound and then developed using the developer obtained in Example 7. As a result, a good printing performance like that in Example 7 was obtained and a good blue was reproduced at an overlapped portion of cyan and magenta. This electrostatic paper was again rewound and then developed using the developer prepared in Example 8. As a result, a good printing performance like that in Example 8 was obtained; besides, a good green was reproduced at an overlapped portion of cyan and yellow, and a good red reproduced at a magenta-yellow overlapped portion.

EXAMPLE 12

The same procedure as in Example 11 was repeated except that first the yellow in Example 8 was developed, then the magenta in Example 7 was developed and thereafter the cyan in Example 1 was developed. In all the cases printing was effected to a satisfatory extent and there were reproduced good green, blue and red at overlapped portions.

EXAMPLE 13

A developer was prepared in the same way as in Example 1 except that the polymer solution obtained in Production Example 7 was used. Using 2 l of the developer, there was made of development in the same manner as in Example 1; as a result, a clear image was obtained. The concentration of the printed image area of cyan of the image was 1.38.

Even after a continuous 1000 m printing for electrostatic paper of A-1 size at a percent image area of 5%, the concentration of the printed image area of cyan was 0.96. In order to obtain the initial developer concentration, the concentrate toner was added to the developer followed by printing; as a result, the concentration of the printed image area recovered to 1.34.

EXAMPLE 14

Using the same developer as in Example 1, there was made development by means of an electrostatic plotter "BENSON-9424" (a product of Benson, Inc., U.S.A.); as a result, a clear image was obtained. The cyan concentration of the printed image area of the image was 1.27.

EXAMPLE 15

Using the same developer as in Example 1, there was made development by means of a wet copier (electrophotographic type) "DT-750" (a product of Ricoh Co., Ltd.); as a result, a clear image was obtained. The cyan concentration of the printed image area of the image was 1.19.

What is claimed is:

1. A liquid developer for electrostatic latent image, comprising the following components (a), (b) and (c) dispersed in an electrical resistive aliphatic hydrocarbon solvent having an electrical resistivity not smaller than $10^9$ Ωcm, a dielectric constant not larger than 3 and a boiling point in the range of 68° to 250° C.:

(a) a copolymer which as a whole is insoluble in said solvent and which consists essentially of a copolymer segment soluble in said solvent and a copolymer segment insoluble in said solvent, wherein said solvent-soluble copolymer segment and said solvent-insoluble copolymer segment are in the proportions of 25–60% by weight and 75–40% by weight, respectively, said solvent-soluble copolymer segment consisting of components:

(i) at least one monomer selected from the group consisting of alkyl acrylates and alkyl methacrylates and (ii) at least one monomer selected from the group consisting of cycloalkyl acrylates, cycloalkyl methacrylates, aralkyl acrylates and aralkyl methacrylates, wherein said components (i) and (ii) being in proportions of 40–80% by weight and 20–60% by weight, respectively, and said solvent-insoluble copolymer segment containing vinyl acetate as a main monomer component, wherein the vinyl acetate content of said solvent-insoluble copolymer segment is in the range of 50 to 100% by weight;

(b) a coloring agent; and (c) a dispersant, wherein the developer is capable of providing a concentration of printed image area of no lower than 0.8, after a continuous 1000 m printing for electrostatic paper of A-1 size at a percent image area of 5% and capable of providing constant concentration of the printed image area by supplying additional concentrate toner to a toner depleted developer.

2. A liquid developer as set forth in claim 1, wherein said aliphatic hydrocarbon solvent is an aliphatic hydrocarbon having a boiling point in the range of 100° to 200° C.

3. A liquid developer as set forth in claim 1, wherein said copolymer which as a whole is insoluble in said solvent has a weight average molecular weight in the range of 5,000 to 50,000.

4. A liquid developer as set forth in claim 1, wherein said solvent-soluble copolymer segment consisting of:

(A) at least one monomer selected from the group consisting of alkyl acrylates and alkyl methacrylates; and (B) at least one monomer selected from the group consisting of cycloalkyl acrylates and cycloalkyl methacrylates.

5. A liquid developer as set forth in claim 1, wherein the alkyl group in said component (a)-(i) has 3 to 20 carbon atoms.

6. A liquid developer set forth in claim 1, wherein said component (a)-(ii) is cyclohexyl acrylate or cyclohexyl methacrylate.

7. A liquid developer as set forth in claim 1, wherein said component (a)-(ii) is benzyl acrylate or benzyl methacrylate.

8. A liquid developer as set forth in claim 1, wherein said solvent-insoluble copolymer segment is a copolymerized units of vinyl acetate with at least one monomer selected from alkyl acrylates and alkyl methacrylates, the vinyl acetate content being not less than 50% by weight.

9. A liquid developer as set forth in claim 8, wherein the alkyl group of said alkyl acrylates or alkyl methacrylates of the copolymer of vinyl acetate has 1 to 20 carbon atoms.

10. A liquid developer as set forth in claim 1, wherein said dispersant is at least one member selected from the group consisting of metal naphthenates, metal octylates and metal stearates.

11. A liquid developer as set forth in claim 1 or claim 2, wherein said dispersant is aluminum stearate.

12. The liquid developer of claim 1, wherein the copolymer of component (a) is a graft copolymer comprising said solvent-soluble copolymer segment having said solvent-insoluble copolymer segment grafted thereon.

13. The liquid developer of claim 1, wherein:

the monomer of (i) is an alkyl (meth)acrylate, in which alkyl is selected from n-butyl, isobutyl, tertiary butyl, 2-ethylhexyl, octyl, isononyl, decyl, lauryl, dodecyl or stearyl; and the cyclic aliphatic (meth)acrylate of (ii) is selected from cyclohexyl acrylate, cyclohexyl methacrylate, benzyl acrylate or benzyl methacrylate.

14. A liquid developer for electrostatic latent image, comprising components (a), (b) and (c) dispersed in an electrical resistive aliphatic hydrocarbon solvent having an electrical resistivity not smaller than $10^9$ Ωcm, a dielectric constant not larger than 3 and a boiling point in the range of 68° to 250° C.:

(a) a copolymer having a molecular weight of 5,000 to 50,000 which as a whole is insoluble in said solvent and which consists essentially of a copolymer segment soluble in said solvent and a copolymer segment insoluble in said solvent, wherein said solvent-soluble copolymer segment and said solvent-insoluble copolymer segment are in the proportions of 25–60% by weight and 75–40% by weight, respectively, said solvent-soluble copolymer segment consisting of components:

(i) at least one monomer selected from the group consisting of alkyl acrylate and alkyl methacrylate, in which the alkyl represents a radical having 3 to 20 carbon atoms and (ii) at least one cyclic aliphatic (meth)acrylate having from 6 to 8 carbon atoms selected from the group consisting of cycloalkyl acrylate, cycloalkyl methacrylate, aralkyl acrylate and aralkyl methacrylate, wherein said components (i) and (ii) being in proportions of 40–80% by weight and 20–60% by weight, respectively, and said solvent-insoluble copolymer segment containing vinyl acetate as a main monomer component, wherein the vinyl acetate content of said solvent-insoluble copolymer segment is in the range of 50 to 100% by weight;

(b) a coloring agent; and (c) a dispersant, wherein the developer is capable of providing a concentration of the printed image area of no lower than 0.8, after a continuous 1000 m printing for electrostatic paper of A-1 size at a percentage image area of 5% and capable of providing constant concentration of the printed image area by supplying additional concentrate toner to a toner depleted developer.

* * * * *